US006988459B2

(12) United States Patent
Roodenburg et al.

(10) Patent No.: US 6,988,459 B2
(45) Date of Patent: Jan. 24, 2006

(54) MULTIPURPOSE TOWER FOR MONOHULL WITH MOVEABLE HATCH

(75) Inventors: Joop Roodenburg, Delft (NL); Robert Frodo Van Kuilenburg, Dordrech (NL); Diederick Bernardus Wijning, Schiedam (NL)

(73) Assignee: Itrec B.V., (NL)

( * ) Notice: Subject to any disclaimer, the term of this patent is extended or adjusted under 35 U.S.C. 154(b) by 0 days.

(21) Appl. No.: 10/966,694

(22) Filed: Oct. 15, 2004

(65) Prior Publication Data

US 2005/0051072 A1 Mar. 10, 2005

Related U.S. Application Data

(62) Division of application No. 10/653,009, filed on Aug. 28, 2003, now Pat. No. 6,871,609.

(60) Provisional application No. 60/407,424, filed on Aug. 30, 2002.

(51) Int. Cl.
*B63B 27/00* (2006.01)

(52) U.S. Cl. ..... 114/268; 114/201 R

(58) Field of Classification Search ..... 114/219, 114/201 R, 268, 230.1, 264
See application file for complete search history.

(56) References Cited

U.S. PATENT DOCUMENTS

| | | | | |
|---|---|---|---|---|
| 3,658,298 A | | 4/1972 | Moore | 254/190 |
| 3,714,995 A | | 2/1973 | Hanes | 175/5 |
| 3,791,628 A | | 2/1974 | Burns | 254/172 |
| 3,804,183 A | | 4/1974 | Duncan | 175/5 |
| 3,917,230 A | | 11/1975 | Barron | 254/173 |
| 3,918,379 A | | 11/1975 | McNary | 114/264 |
| 3,949,693 A | | 4/1976 | Bauer | 114/265 |
| 4,423,994 A | | 1/1984 | Schefers | 414/22 |
| 4,601,252 A | * | 7/1986 | Wuttudal | 114/230.12 |
| 4,620,692 A | | 11/1986 | Foreman | 254/277 |
| 4,688,764 A | | 8/1987 | Nayler | 254/277 |
| 4,867,418 A | | 9/1989 | Daniels | 254/277 |
| 5,778,815 A | | 7/1998 | Shields | 114/201 |
| 5,894,895 A | | 4/1999 | Welsh | 175/5 |
| 6,698,372 B2 | | 3/2004 | Hobdy | 114/230.12 |

FOREIGN PATENT DOCUMENTS

| | | |
|---|---|---|
| GB | 2087342 | 4/1981 |
| GB | 2171974 A | 3/1986 |
| NL | 1009043 | 4/1998 |
| WO | WO 9911518 | 8/1998 |

* cited by examiner

*Primary Examiner*—Stephen Avila
(74) *Attorney, Agent, or Firm*—Buskop Law Group, P.C.; Wendy Buskop

(57) ABSTRACT

Embodied herein is a monohull vessel with a moonpool capable of being used offshore. The monohull vessel includes a moonpool and a deck level. A movable hatch is connected to topside of the moonpool and is countersunk beneath the deck level. A multipurpose tower is mounted on the monohull vessel. The monohull vessel includes an equipment handling system removably mounted on the vessel and a hoist system located inside the monohull vessel.

37 Claims, 14 Drawing Sheets

59
199
196
195
191
31
113
1
181
183
199
197
193
165
117
119
177
175
167
168
169
170
171
179
10
7
13
27
161
8
29
5

MULTIPURPOSE TOWER FOR MONOHULL WITH MOVEABLE HATCH

The present application is a divisional of U.S. patent application Ser. No. 10/653,009, filed on Aug. 28, 2003, now U.S. Pat. No. 6,871,609 issued Mar. 29, 2005, which claims priority to U.S. Provisional Patent Application No. 60/407,424, filed on Aug. 30, 2002.

FIELD

The present embodiments relate to a vessel for use in the offshore industry on which a multipurpose tower and a module handling system are mounted.

The module handling system includes a module moving system that can move heavy equipment and sub sea modules over the deck of the vessel. The system has a moonpool hatch that can stabilize modules when items are lowered or hoisted through the moonpool. The moonpool hatch can serve as a working platform and as a support for the module moving system.

The multipurpose tower is fitted with a main and auxiliary trolley, hoists, and cable, as well as accommodations for an elevating working platform.

BACKGROUND

Today a significant percentage of the production equipment is not installed on the surface of the sea, but on the sea bottom. As with all equipment, the equipment on the sea bottom needs regular maintenance. Specifically, during the lifetime of an oilfield, the bore holes and the oilfield itself need maintenance to keep the production as high as possible.

Maintenance of the oil field and the production equipment on the sea bottom is a difficult task that is both time intensive and very expensive.

To perform this maintenance, special vessels are typically needed. Some of the special vessels are known as semi-submersibles and drill ships. These ships have a number of disadvantages. The main disadvantages are their low transit speeds and high daily running cost.

New builds or converted non-dedicated ships, so-called "well intervention vessels", are increasingly being used to install equipment on the sea bottom and to perform maintenance. The main advantages of small ships are low running cost and acceptable transit speeds. The disadvantage is that these small ships tend to have bad motion characteristics. The small ships move a lot more compared to the bigger units thereby limiting their use to only "good weather windows".

Well intervention involves everything from lowering a ROV to do a visual check to lowering entire production or maintenance units to the sea bottom and retrieving the units. During the intervention operation, units have to be moved over the deck of the vessel from and to storage areas, the moonpool, and maintenance areas. Often these units are big and heavy and handling them are difficult and dangerous tasks. Sometimes these modules are required to be stacked on top of each other prior to lowering them to the seabed. Often crewmembers have to work on elevated levels to be able to reach all parts of the units. Current practice is the use of man-riding winches. Again, this is both dangerous and time consuming. Many accidents have occurred with the use of man riding winches.

Moving heavy objects also requires the use of cranes. Moving and lifting modules on a moving deck can be quite dangerous and numerous accidents have occurred during this kind of activities.

Apart from moving objects on the decks, lowering and lifting of the units through moonpools located in the vessel creates some specific problems. When lowering units through the moonpool, the objects tend to swing form side to side. Considerable risk of damage to the unit or the vessel arises when the modules are not constrained in some way.

Retrieving objects through the moonpool is equally dangerous. The relative motion of the vessel and the modules can be such that there is also the danger of the module hitting the vessel and thereby endangering the vessel and the lives for the crew.

According to prior art, standard drilling derricks are used in well intervention. The standard drilling derricks have an inverted U shape to lower to and lift objects of the seabed. This shape severely limits the size of the modules that can be handled since every module has to pass through the V-door of the drilling derrick. The two vertical support structures on most standard vessels severely limit the area that can be reached by other cranes and equipment of the vessel.

Due to the construction of the drilling derricks, the drilling derricks must be placed at specific locations in order not to hinder other equipment. This restriction limits the freedom in the design of the vessel considerably. Removing the drilling derrick from the vessel when the derrick is not used is a difficult task due to the size and the weight of the drilling derrick.

A need exists for a module handling system for a well intervention vessel that can be removable mounted on a vessel; has a large freedom of placement on the vessel; does not claim a large working space; can safely move heavy and large objects around the deck; can lower and retrieve modules from the seabed through the moonpool; allows work on the modules on elevated levels safely; and allows modules to be placed on the seabed accurately.

The object of the current embodiments is to address the problems in the prior art and provide a tower for a monohull with a substantially hollow mast and at least one hoisting device.

BRIEF DESCRIPTION OF THE DRAWINGS

The present embodiments will be explained in greater detail with reference to the appended Figures, in which.

The present embodiments are detailed below with reference to the listed Figures.

DETAILED DESCRIPTION OF PREFERRED EMBODIMENTS

Before explaining the present embodiments in detail, it is to be understood that the embodiments are not limited to the particular embodiments herein and it can be practiced or carried out in various ways.

The present embodiments provide modular handling packages wherein the above-mentioned drawbacks are avoided at least to a considerable extent.

Figure 1:
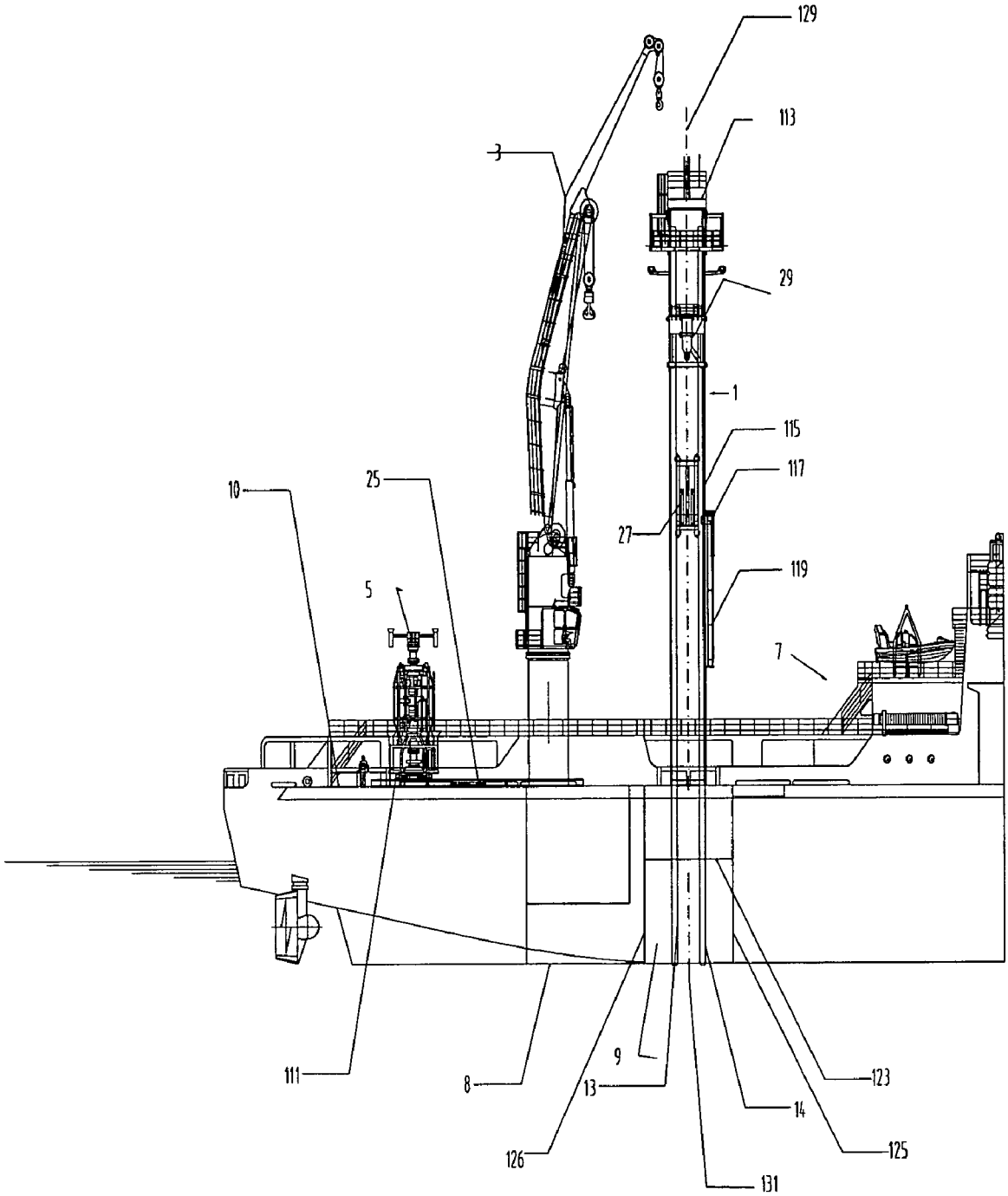
FIG. 1 depicts a side view of a vessel with a module handling system installed.

With reference to the figures, FIG. 1 depicts a side view of a vessel (7) on which a multipurpose tower (1) is mounted on deck (10). As an example, a "Knuckleboom" Crane (3) is mounted on the vessel (7). The "Knuckleboom" crane (3) can be used to pick up equipment and tools from the quay and load them onto the vessel.

The multipurpose tower (1) is located next to moonpool (9). The first trolley guiding rail (13) and second trolley guiding rail (14) are connected to the front of multipurpose tower (1) and run into moonpool (9) to the bottom (8) of the vessel (7). In this embodiment, the main trolley (29) and auxiliary trolley (27) can move from the top side (113) of the multipurpose tower (1) to the bottom (8) of the vessel (7). The main trolley (29) and auxiliary trolley (27) can be connected to module (5) while module (5) is lowered into moonpool (9). This connection prevents any free movement of module (5) while the module (5) is being hoisted of lowered into of from moonpool (9).

When the module (5) reaches bottom (8) of vessel (7), both trolleys disconnect. Since the module is now under water level (123), the motions of module (5) are considerably reduced thereby reducing the risk of module (5) hitting first side wall (125) or second side wall (126) of the moonpool. The module (5) has to be lowered only a small distance in order for the module (5) to clear from vessel (7) completely.

Continuing with FIG. 1, the skid cart (111) is secured to the sub-sea module (5). The storage area (117) is fixably mounted on side (115) of multipurpose tower (1). The storage area (117) holds, in this particular embodiment, a riser (119), but the storage area is not limited to risers only. Other equipment such as hoses, drill pipe, and casing can be stored in the storage area (117).

FIG. 1 also shows that the centerline (129) of multipurpose tower (1) coincidences with centerline (131) of moonpool (9). Even though this is preferred embodiment, other arrangements of the multipurpose tower (1) in relation to the moonpool (9) are also possible.

Figure 2:
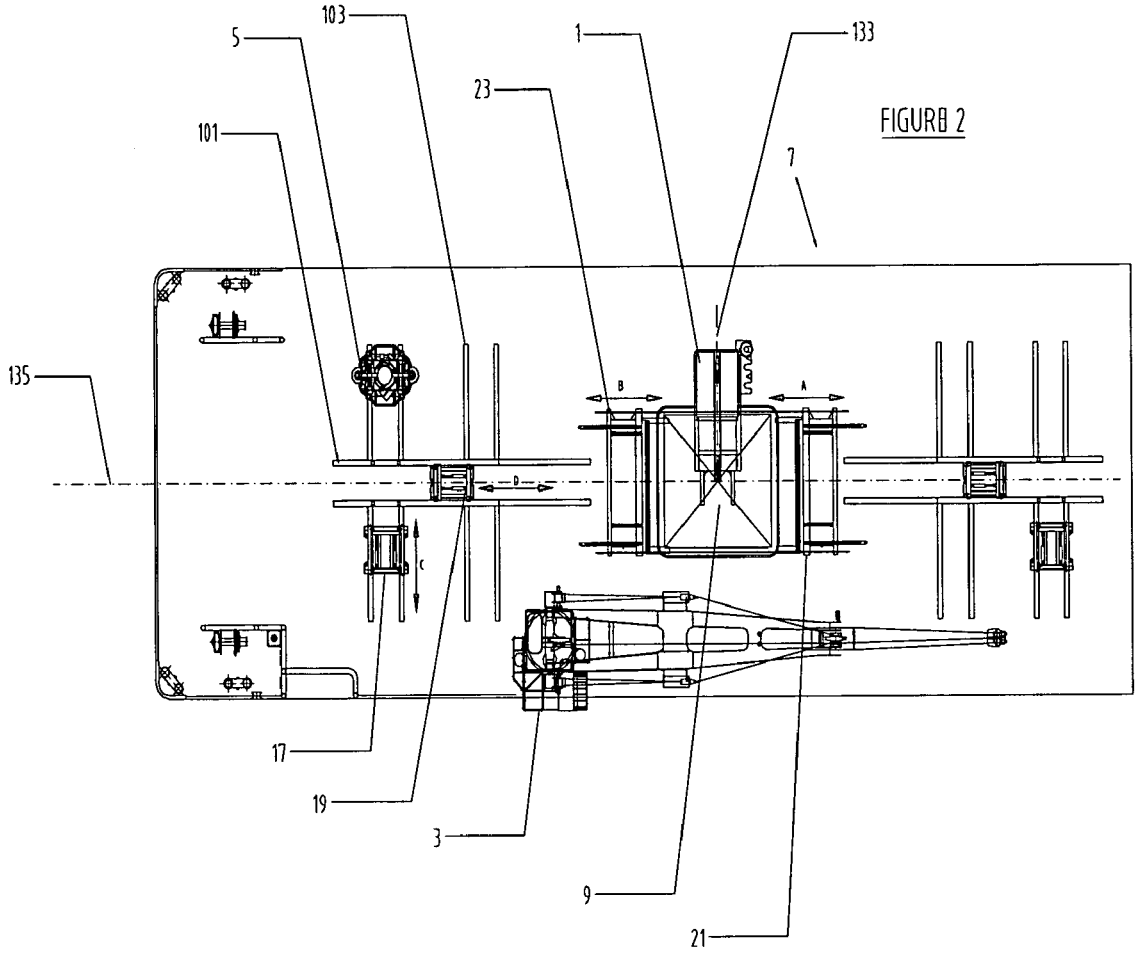
FIG. 2 depicts a top view of a vessel with module handing system installed.

FIG. 2 depicts a top view of deck (10) of vessel (7). The multipurpose tower (1) is located next to moonpool (9) in such a way that first and second trolley guiding rails (13 and 14), which are not visible in FIG. 2, run directly from topside (113) of the multipurpose Tower (1) to the bottom (8) of vessel (7).

The first hatch (23) and second hatch (21) are visible in FIG. 2. The first hatch (23) and second hatch (21) can move over deck (10) in directions indicated with A and B respectively. The movement of first hatch (23) and second hatch (21) respectively is always perpendicular to second multi purpose centerline (133) of multipurpose tower (1). This movement is needed because otherwise the hatches would collide with the multipurpose tower.

Also in FIG. 2, the module (5) can be moved over deck (10) of vessel (7) with the aid of transversal push-pull unit (17) and longitudinal push-pull unit (19). The transversal push-pull unit (17) moves over skid rail topside (91) while the longitudinal push pull unit (19) moves inside longitudinal skid rails (101). By using the longitudinal push pull unit (19) and transversal push pull unit (17), the module (5) can be moved over the whole area of deck (10) provided that a multitude of longitudinal skid rails (101) and transversal skid rails (103) are installed.

The skid cart (111), not visible in FIG. 2, can be secured to the module (5). The skid cart (111) skids over longitudinal skid rails (101) and transversal skid rails (103), which are removably mounted on deck (10).

Figure 3:
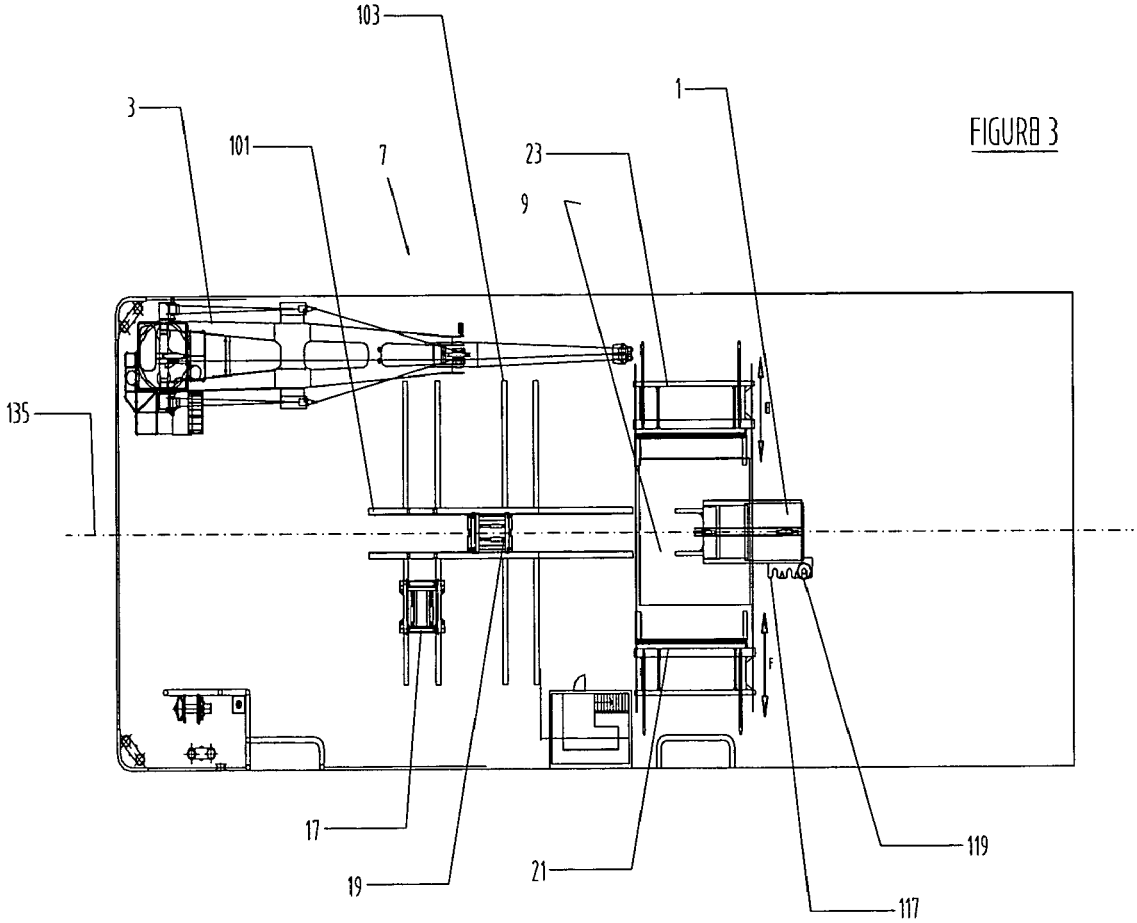
FIG. 3 depicts a top view of a vessel with multipurpose tower in another direction.

FIG. 3 depicts a different placement of multipurpose tower (1) on vessel (7) in which first and second hatches (21 and 23) move perpendicular to the longitudinal axis (135) of vessel (7). The choice of placement of the moonpool (9) and multipurpose tower (1) is governed by operational and technical conditions.

Working on well intervention vessels is dangerous and demanding since the deck of the vessel is moving considerably in all directions. Bad weather and unfavourable wind and water conditions can increase the difficulty of the work. In addition, any motion of the well intervention vessel is amplified when working at elevated heights. On most vessels, crew members that have to work on elevated levels are being hoisted by so called "man riding winches". The use of man-riding winches no matter how reliable they are has caused a large number of accidents often with deadly consequences.

Figure 4:
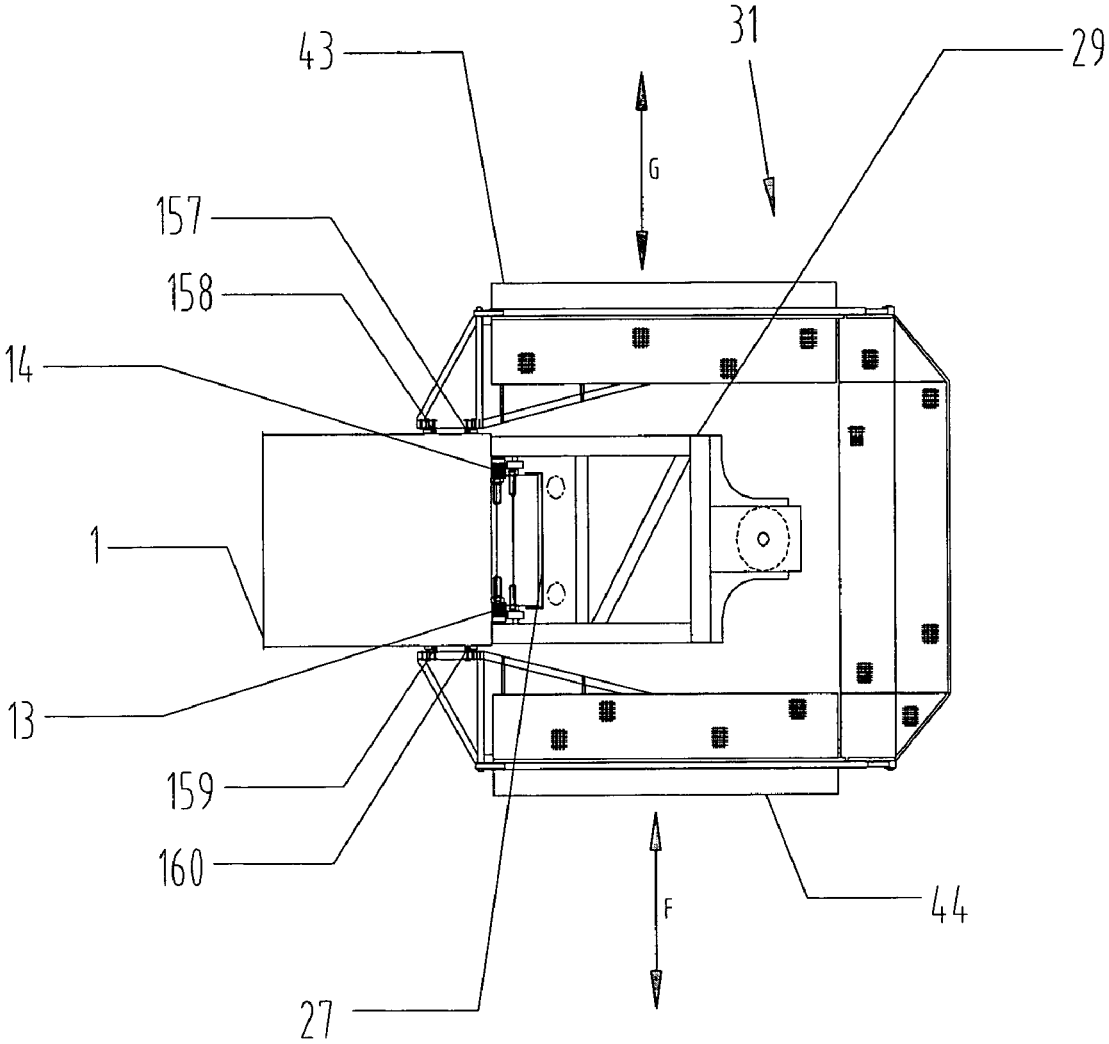
FIG. 4 depicts a top view of a working platform.

FIG. 4 depicts an elevating working platform (31). The elevating work platform moves on the outside of multipurpose tower (1) over first rail (157), second rail (158), third rail (159), and fourth rail (160) and makes "man riding winches" superfluous.

The size of working platform (31) is such that the platform (31) can pass the main trolley (29) and auxiliary trolley (27) without interference. The working platform (31) can pass the module (5), which is not shown in this FIG. 3, when the module (5) is being hoisted by main hoist (59). Movable plates (43 and 44) located on working platform (31) can move in the directions indicated with the letters F and G.

Often different modules have different sizes. In order to allow the crew to work on the modules in a safe and efficient matter, the movable plates (43 and 44) are adapted to move in order to minimize the gap between the modules and working platform (31). By minimizing this gap, crew members and tools are less likely to fall. An additional precaution to protect the crew working platform (31) can include fitting the elevating working platform (31) with a railing (151). In another embodiment, the elevating working platform (31) can be fitted with a wind wall or other protection devices.

Figure 5:
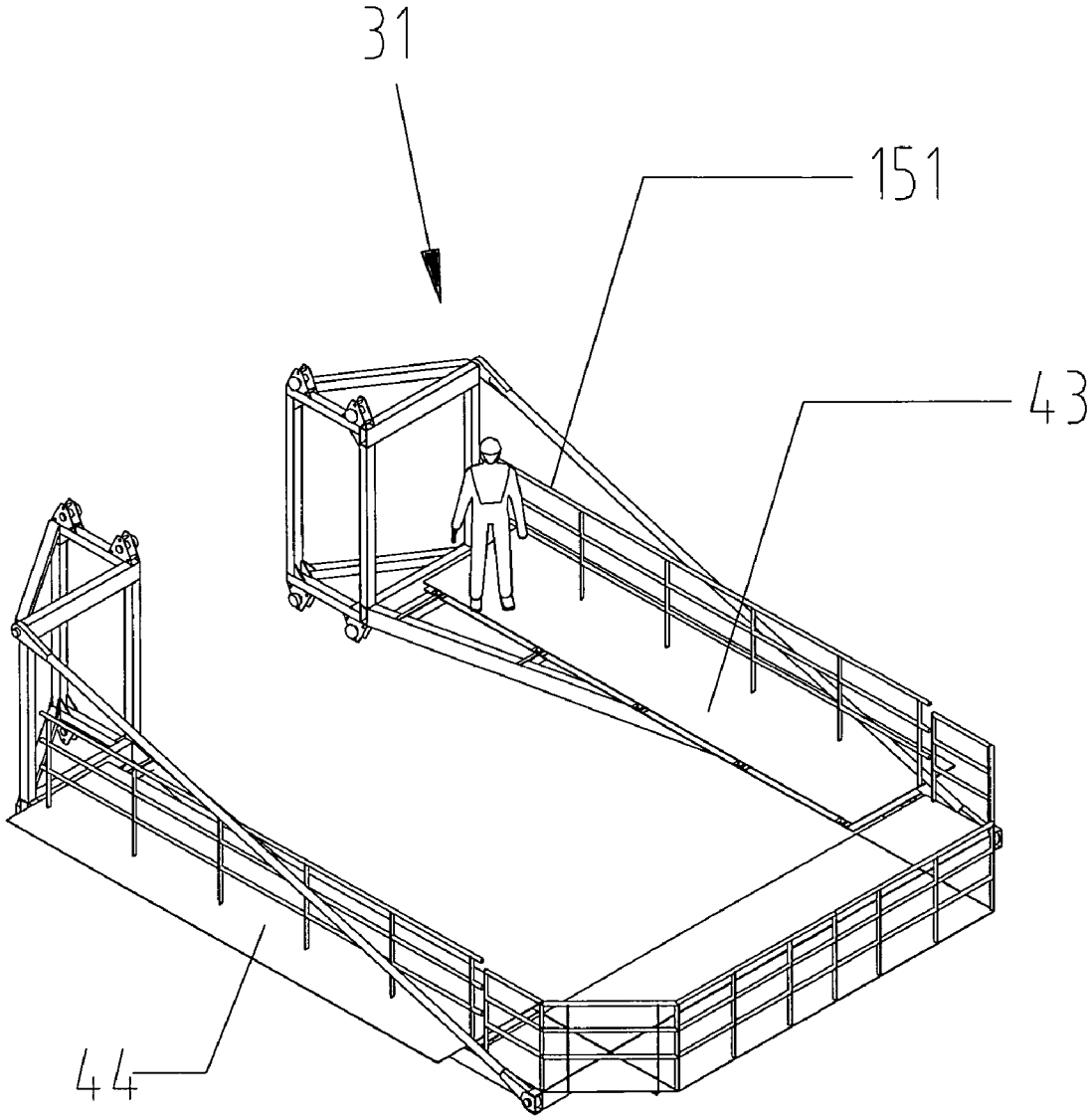
FIG. 5 depicts a perspective view of a working platform.

FIG. 5 depicts a perspective view of elevating working platform (31). In order to move the crew and tools from deck (10) to elevating working platform (31), the elevating is hoisted to elevated levels. In this embodiment shown in FIG. 5, the auxiliary trolley (27) is being used for this purpose.

Figure 6:
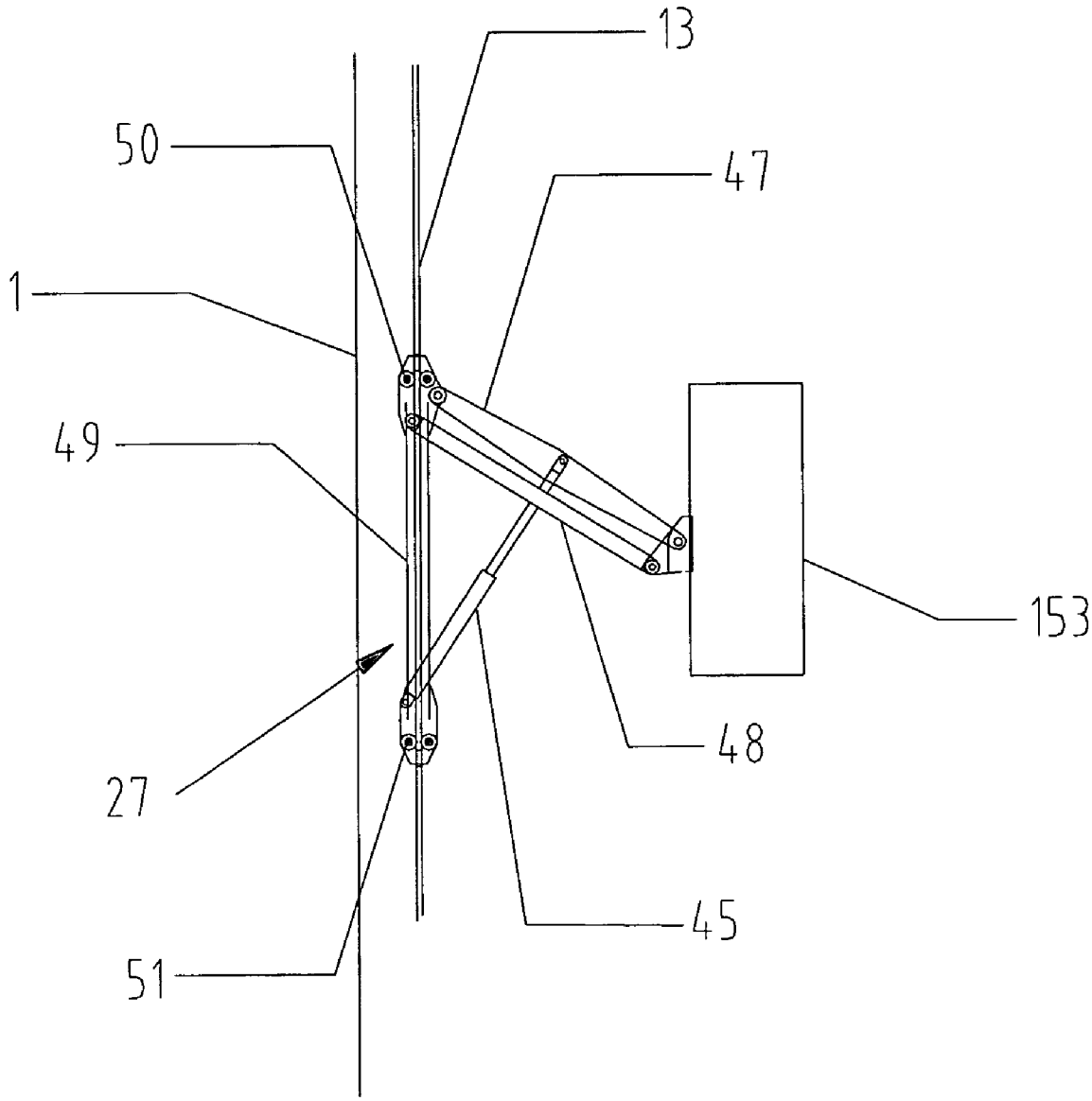
FIG. 6 depicts a side view of an auxiliary trolley.

FIG. 6 depicts a side view of auxiliary trolley (27) in which first and second moving arms (47 and 48) are visible. Due to the parallelogram construction shown in FIG. 6 any load that is picked up by the moving arms (47 and 48) does not rotate when the moving arms move outward. The moving arms can connect to a basket (153) to transport crew and equipment to working platform (31). The moving arms (47 and 48) can move inward in order to let auxiliary trolley pass main trolley (29) and module (5) without interference.

The auxiliary trolley (27) can also used to stabilize the module (5) when the module (5) is being hoisted or lowered. In this case, the moving arms move outward until a connection can be made with the module (5). The auxiliary trolley (27) moves on the inside of first and second trolley guiding rails (13 and 14) mounted on front side multipurpose tower (1). The auxiliary trolley (27) is guided ion the rails (13 and 14) by first and second wheel sets (50 and 51) which are fixably connected to auxiliary trolley main structure (49).

Continuing with FIG. 6, moving the moving arms (47 and 48) is accomplished by hydraulic cylinder (45). In this embodiment, the hydraulic cylinder (45) can be controlled in such a way that the hydraulic cylinder (45) can act as a damper. This dampening is advantageous when modules that are being hoisted in the moonpool have to be stabilized.

The stabilization is partly done by using the auxiliary hoist (27) by controlling the hydraulic cylinder (45) to act as a damper until movement of module (5) is decreased such that a fixed connection between moving arms (47 and 48) and the module (5) can be made. After the connection is complete, the moving arms (47 and 48) extend or retract to align the module (5) to multipurpose tower (1). Large forces can occur during the damping phase and the auxiliary trolley (27) has a relative heavy construction to cope with these forces.

Figure 7:
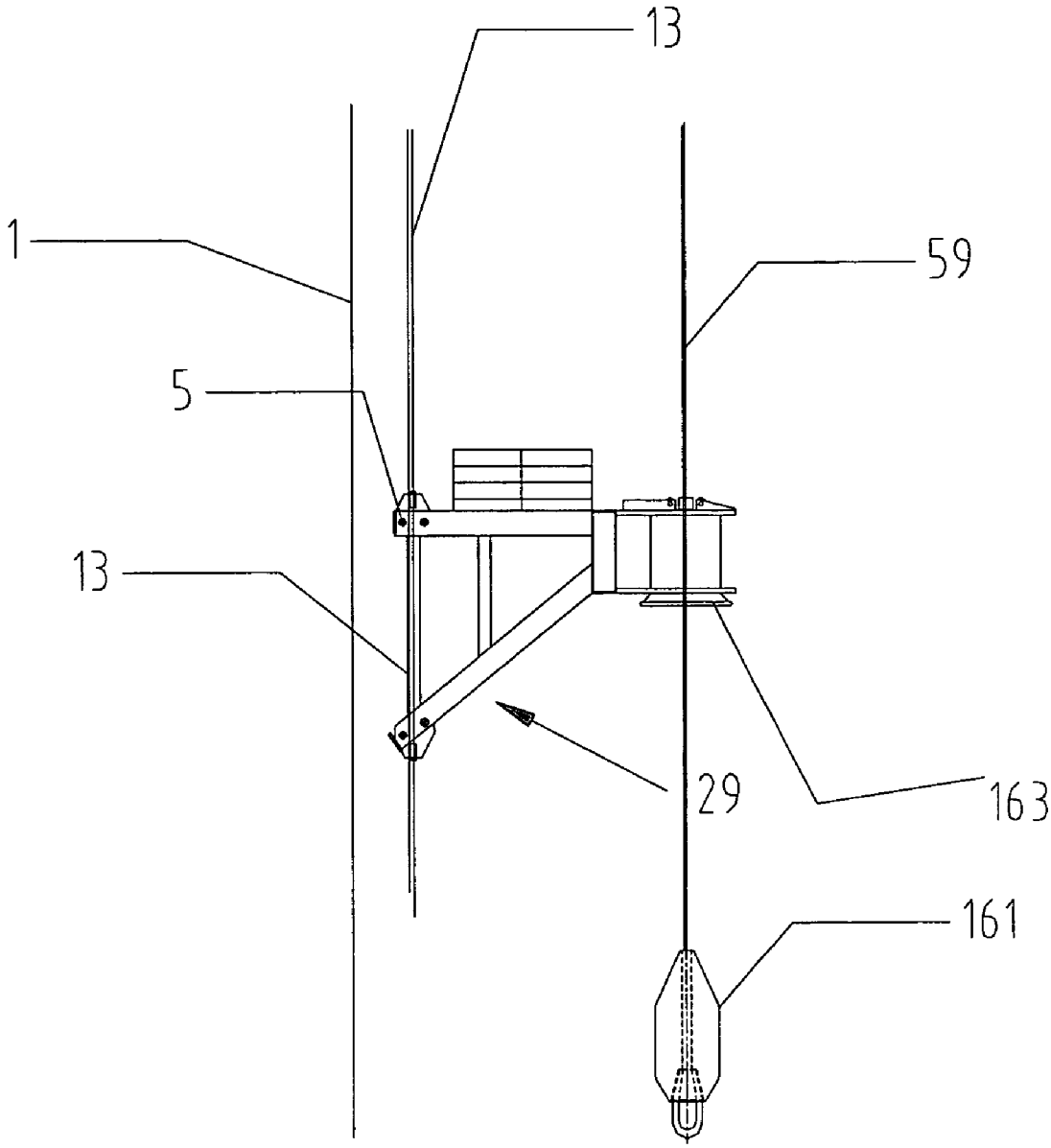
FIG. 7 depicts a side view of a main trolley.

FIG. 7 depicts a side view of main trolley (29). The main purpose of the main trolley (29) is to center the main hoist wire (59) in order to prevent the main trolley (29) from swinging and consequently to prevent the module (5) from swinging when hoisted. Centering the main hoist wire is accomplished by letting main hoist wire (59) to run through a fitting hole in main trolley (29). The main trolley (29) can move freely on rails (13 and 14) without interference with the auxiliary trolley (27) and working platform (31).

The ball weight (161) is used in hoisting the main trolley. The ball weight (161) is located at the end of the main hoist wire (59). The main hoist wire (59) connects to a catching cone (163) fixably mounted on main trolley (29). While the load is lowered into the moonpool, the main trolley (29) moves to bottom (8) of the vessel where the main trolley (29) disconnects from the ball weight (161) while the load is lowered further. The shape of the ball weight (161) is such that the ball centers when the ball weight (161) enters the catching cone (163) of the main hoist (29). This method ensures that no locking devices are necessary in this embodiment although operational demands could make additional locking of the ball weight (161) and catching cone (163) necessary.

Figure 8:
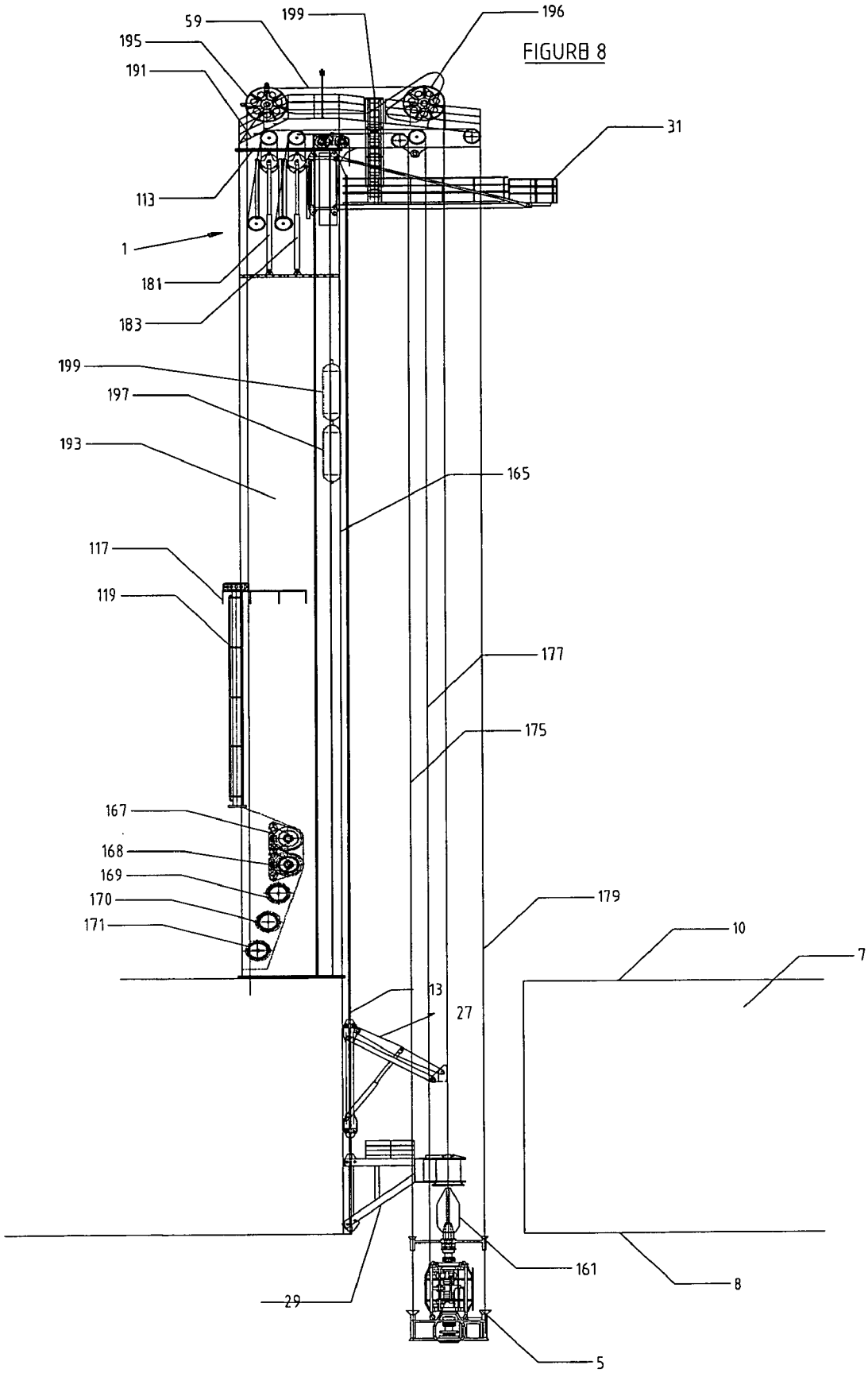
FIG. 8 depicts a side view of a multipurpose tower.

FIG. 8 depicts a side view of multipurpose tower (1). The multipurpose tower (1) is mounted on the deck (10) of the vessel (7). The first and second trolley guiding rails (13 and 14) are mounted on front side (165) of multipurpose tower (1) and are also mounted on moonpool side wall (131). The rails (13 and 14) run to the vessel bottom (8) to allow the auxiliary trolley (27) and main trolley (29) to move from multipurpose tower top side (113) to the vessel bottom (8) through moonpool (9).

Multiple winches are located inside multipurpose tower (1). As seen in FIG. 8, these winches are the first winch (167), second winch (168), third winch (169), fourth winch (170), and fifth winch (171). The winches are installed at a low elevation level creating the advantage of a lower centre of gravity of the vessel.

The winches (167, 168, 169, 170 and 171) are used to hoist auxiliary trolley (27), working platform (31), and a plurality of wires. The winch used by the hoist system can be a traction winch. Of the plurality of wires, FIG. 8 depicts three: first wire (175), second wire (177) and fourth wire (179). The wires can be connected to the module (5) and are lowered with the module (5) to the sea bottom.

The wires (175, 177 and 179) run from the third winch (169), the fourth winch (170), and the fifth winch (171) to the first compensation system (181), the second compensation system (183), and the third compensation system (187), respectively. The wires are run over a multitude of sheaves located in masthead (191).

Between the winches (167, 168, 169, 170 and 171) and the module (5), heave compensation systems can be installed. FIG. 8 shows two of those heave compensation systems (181 and 183). The heave compensation systems (181 and 183) are fixably mounted to multipurpose tower (1) near multipurpose tower top side (113).

As seen in FIG. 8, nearby the heave compensation systems (181 and 183), a first and a second pressure vessel (197 and 199) are fixably mounted to multipurpose tower (1) and connected to said heave compensation systems. The number of pressure vessels does not need to be the same as the number of heave compensation systems.

The main hoist wire (59) runs from the inside of the vessel (7) to the inside (193) of multipurpose tower (1), over the first sheave (195), and the over the second sheave (196). The first sheave (195) is fixably connected to masthead (191) while the second sheave (196) is rotably fixed to masthead (191).

A ladder (199) is connected to the masthead (191) to allow the crew to move from the elevating working platform (31) onto the masthead (191) in a safe and orderly manner. This ladder is advantageous because large pieces of equipment can now be transported to the masthead without the restrictions of the limited space and the crew does not need to climb a large number of stairs or ladders to reach the masthead (191). Also seen in FIG. 8, the riser storage (117) is fixably connected to multipurpose tower (1) with a riser (119) located in the storage.

Figure 9:
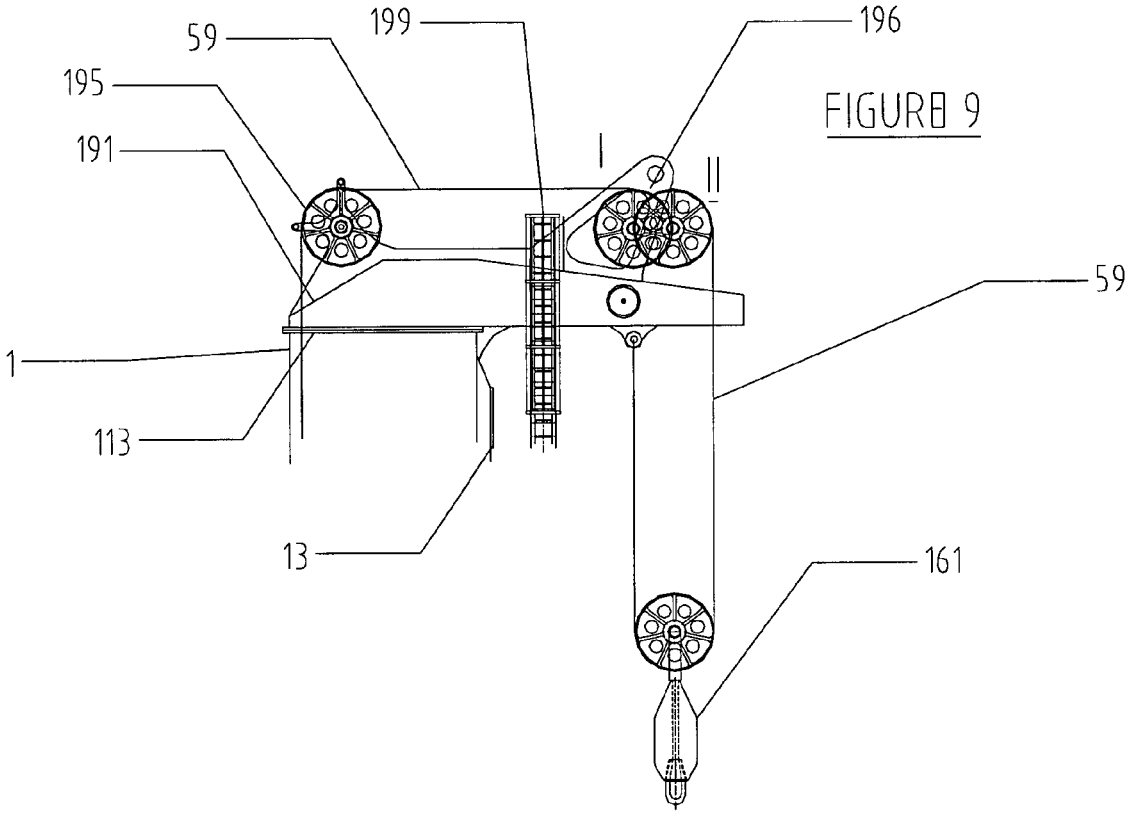
FIG. 9 depicts a detailed view of a mast head of a multipurpose tower.

FIG. 9 depicts the masthead (191) with optional positions for the sheave (196). The sheave (196) is rotably connected to masthead (191). In the first position (denoted with the roman capital I), the main hoist wire (59) runs directly to module (5). In the second position (denoted with the roman capital II), the main hoist wire runs from the sheave (196) to the third sheave (201) that is connected to the ball weight (161) and then connected to the masthead (191). In sheave position II, a heavier load can be hoisted compared to sheave position I although at a lower speed. Changing from position I to position II is relatively easy and takes little time. The advantage is that with the same multipurpose tower now has a wide range of loads that can be hoisted safely.

Figure 10:
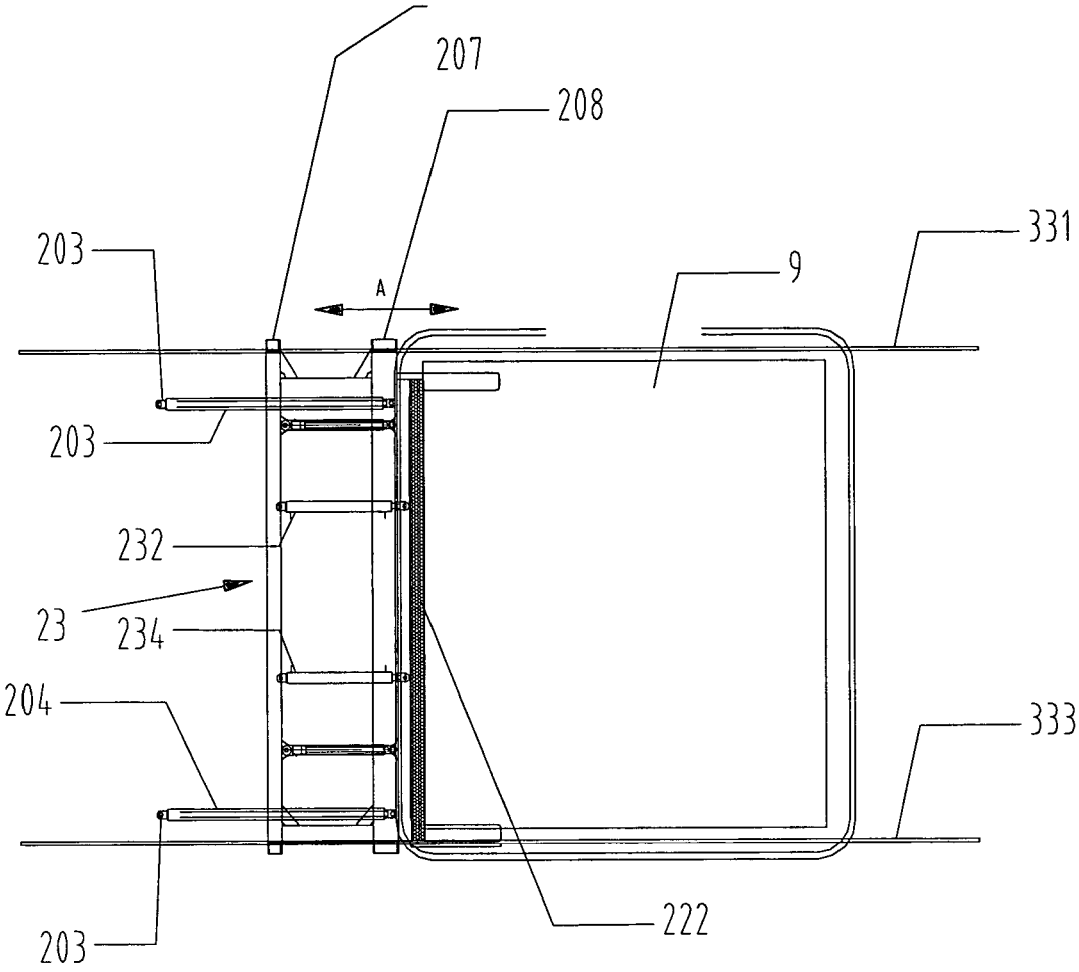
FIG. 10 depicts a top view of a moveable hatch.

FIG. 10 depicts a top view of the first hatch (23) located next to the moonpool (9). The first hatch (23) and the second hatch (21) are in a preferred embodiment identical in construction. The first hatch comprises a first structural beam (207) and a second structural beam (208) fixably connected to each other that can be moved in direction A by a first and a second hydraulic cylinder (203 and 204). The cylinders are connected on one side to the deck (10) of the vessel (7) and to the first hatch (23).

Also visible in FIG. 10 is the fender (222). The fender (222) cane can move in the direction denoted as "A". The fender (222) is connected with hydraulic cylinders (232 and 234) to the structural frame (207). The fender (222) is located on the side that is oriented to the center of the moonpool (9). The fender (222) can be moved in three ways: by moving structural frame (207), by extending or retracting hydraulic cylinders (232 and 234) while structural frame (207) is not moving, and by moving both the structural frame (207) and hydraulic cylinders (232 and 234).

The hydraulic cylinders can be controlled to act as shock dampers. When the module (5) is hoisted into the moonpool (9) the movements of the module have to be minimized in order to prevent damage to the moonpool. This minimizing of movements is done by moving the second hatch (21) and the first hatch (23) simultaneously to the center of moonpool (9) with the fenders fully extended and damping out any excess movement of module (5).

The fender (222) includes a shock absorbing material to minimize impact damage. In a preferred embodiment this material is wood or rubber but other materials can be used as well. Once the module (5) is stationary the auxiliary trolley (27) can dampen out the remaining movements of the module (5).

Often the modules are lowered to the seabed. Lowering the modules to the seabed requires a power supply or other services from the vessel to function properly. Another module can be lowered on top of the first module already installed on the sea bottom. In order to guide any extra modules, wire guides are used to guide the modules to the correct place without the need for alignment from a ROV. These wire guides run from the module on the sea bottom through the moonpool to the top of the multipurpose tower in this specific embodiment. Up to seven wires and two umbilical wires can be run down at the same time.

When a new module is lowered to the seabed first, the module has to be connected to the guide wires. Sometime the module is of a size that the module cannot move without interference between the wires. In this case, the wires have to be moved apart to create the space needed for passage of the new module. Another problem that occurs is that the movement of the vessel causes the wires to move inside the moonpool of the vessel thus making it difficult to catch and secure the wires. All above mentioned actions and functions have to be incorporated in the moving hatches.

Figure 11:
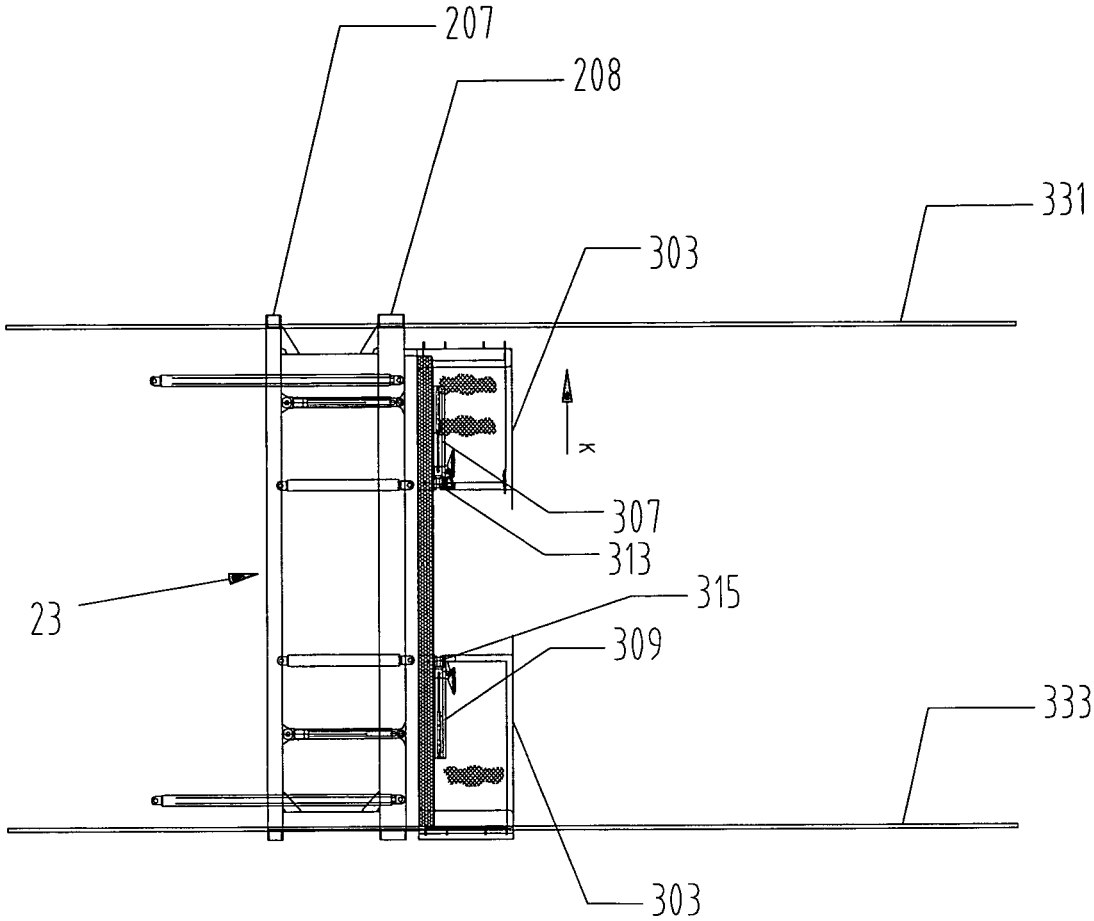
FIG. 11 depicts a detailed top view of a moveable hatch.

FIG. 11 depicts a detail of the first hatch (23) with first and second secondary hatches (303 and 305) movably mounted. The first and second wire catching systems (307 and 309) are located on the first and second secondary hatches. The purpose of the catching systems is twofold: gripping the wires and moving the wires. The purposes are accomplished by a gripping system (311) mounted on first secondary hatch (303) that can move in direction indicated by the capital "K" in the figure by a hydraulic cylinder (313). Likewise, a gripping system (315) is mounted on second secondary hatch (305).

Figure 12:
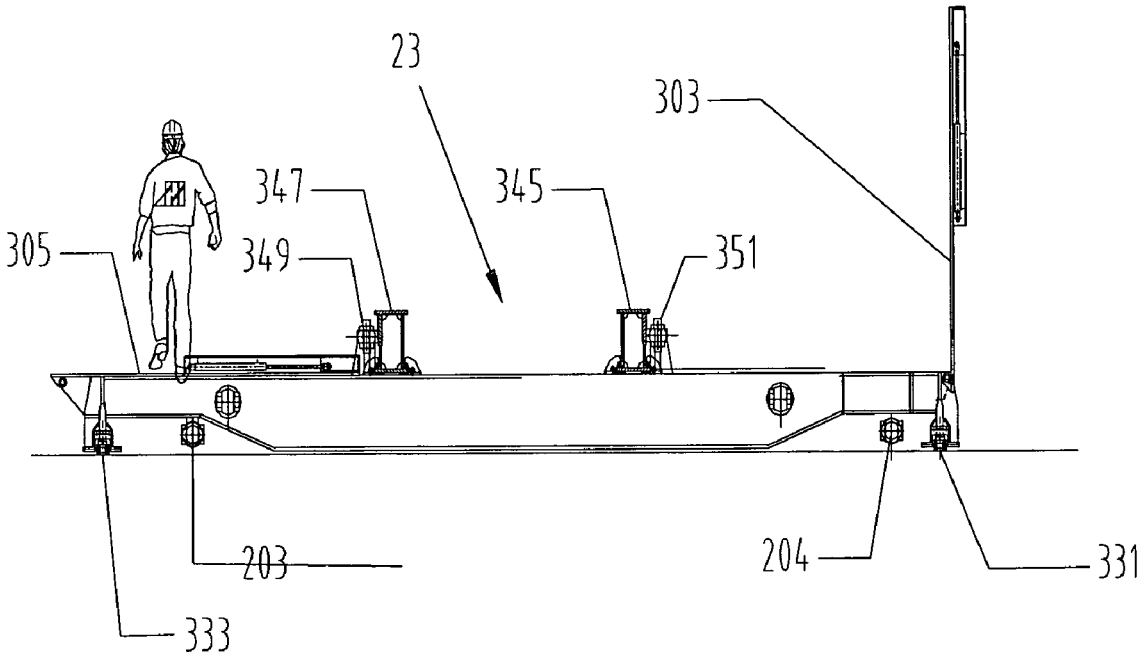
FIG. 12 depicts a side view of a moveable hatch.

FIG. 12 depicts a side view of the first hatch (23) on which first secondary hatch (303) is visible in the open position and the second secondary hatch (305) is visible in the closed position. In the open position of secondary hatches (303 and 305), the secondary hatches do not interfere with the stabilization procedure of the module (5) using the fenders. In the closed position, secondary hatches form a safe working platform over the moonpool. The first hatch moving system (203) and the second hatch moving system (204) are visible in FIG. 12. In a preferred embodiment, these systems are hydraulic cylinders, but other moving systems can be used as well. The first hatch (23) slides on rails indicated by numbers (331 and 333).

When the multipurpose tower (1) is oriented on the vessel (7) as indicated in FIG. 3, the rails in which longitudinal push-pull unit (19) moves can be an integral part of the movable hatches. Once the hatches are fully opened, the moonpool (9) is completely cleared. If the multipurpose tower (1) is orientated as indicated in FIG. 2, the rails are not an integral part of the movable hatches.

Figure 13:
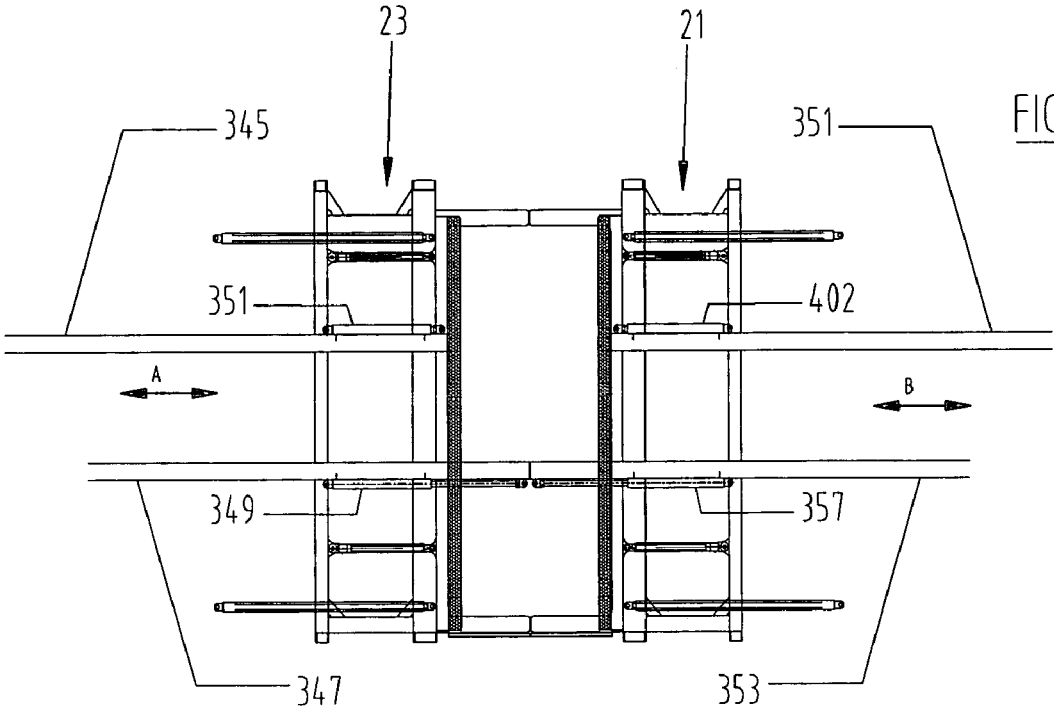
FIG. 13 depicts a top view of two hatches with rails.
Figure 14:
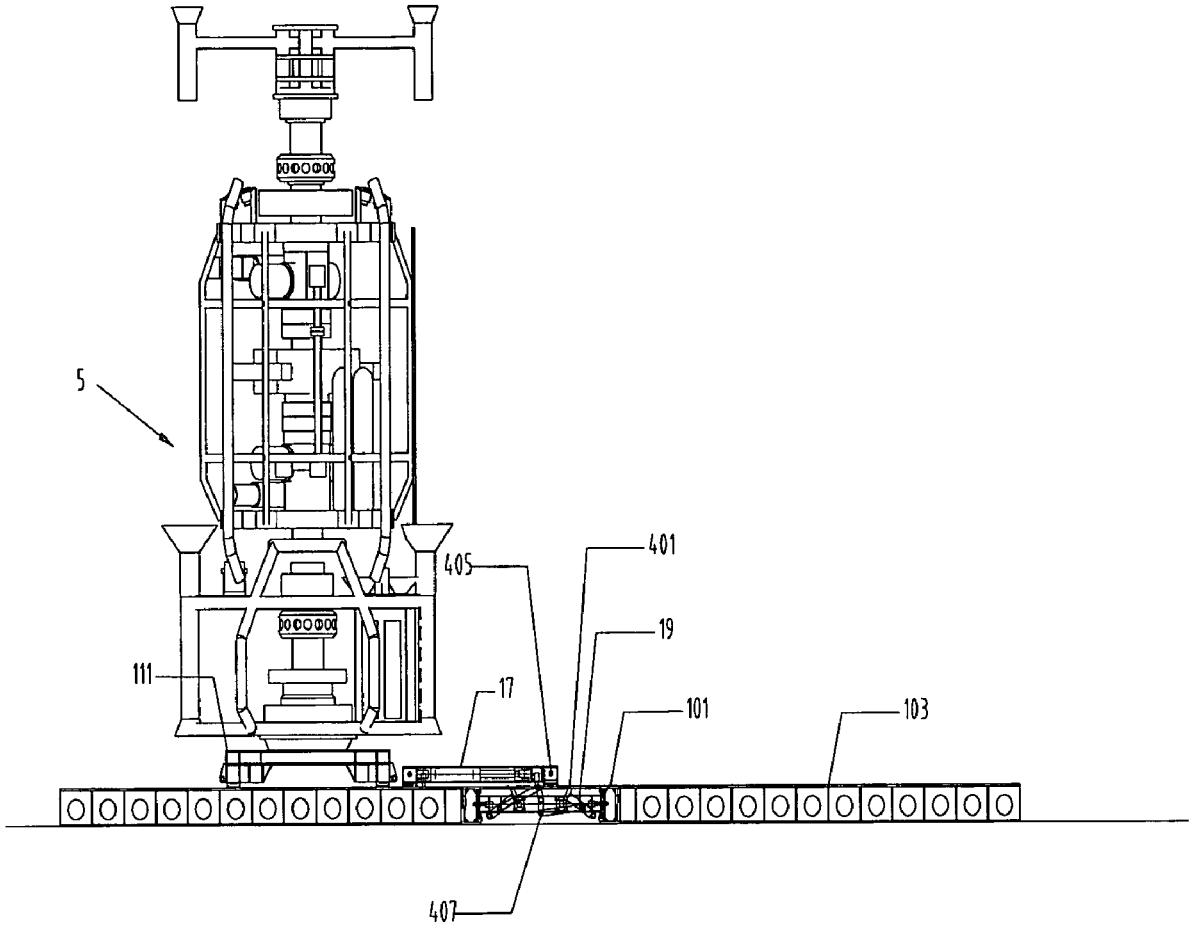
FIG. 14 depicts a side view of the rail system.

FIG. 13 depicts the first and second rails (345 and 347) that slide over first hatch (23) moved by first rail cylinder (349) and the second rail cylinder (351). The first rail (345) and the second rail (347) move in the same direction as the first hatch (23) indicated in the figure by letter "A". The first rail (345) is shown in a fully retracted position while the second rail is shown in fully extended position.

The third rail (351) and the fourth rail (353) can slide over second hatch (21) moved by third rail cylinder (355) and fourth rail cylinder (357). The third rail (351) and fourth rail (353) move in the same direction as the second hatch (21) as indicated by in the figure by the letter "B". The third rail (351) is shown in a fully retracted position while the fourth rail is shown in a fully extended position.

When the all of the rails are in a fully retracted position, the moonpool (9) is completely cleared. When first rail (345), second rail (347), third rail (351) and fourth rail (353) are fully closed, the longitudinal push-pull unit (19) can move over the moonpool (9) to transport the module (5) to the centerline of the moonpool (9) or to the other side of the moonpool (9).

In FIG. 12, the first rail (345), the first rail cylinder (349), the second rail cylinder (351), and the second rail (347) are also visible.

FIG. 13 depicts a side view of the transversal rail (103) and a cross view of longitudinal rail (101). In this specific embodiment, the transversal push-pull unit (17) is moving on the top side of rail (103) while the longitudinal push-pull unit (19) is moving inside longitudinal rail (101). The transversal push-pull unit can slide over the topside of longitudinal push-pull unit as indicated by the reference numeral 401 and is able to pass over the longitudinal rail (101).

The moving system to move the longitudinal push-pull unit (101) is well known from previous art. Both the longitudinal push-pull unit (101) and the transversal push-pull unit (103) are fitted with locking devices indicated by reference numerals 405 and 407 to prevent the module (5) from moving in unwanted directions. The power to drive the push-pull units in a preferred embodiment is delivered by a central power unit. Each push pull unit can be fitted with an independent power unit as well.

A method for catching and stabilizing sub sea equipment in a moonpool begins by hoisting equipment from the sea bottom into the moonpool and catching the lifting hook using the main trolley located at the bottom of the moonpool. The next steps include further hoisting the equipment into the moonpool together with the main trolley and stabilizing the equipment in one direction by using two movable hatches. The method ends by stabilizing the equipment in a direction perpendicular to the first direction by using an auxiliary trolley with movable arms and lifting the stabilized equipment into the multipurpose tower together with the main trolley and the auxiliary trolley.

A method for lowering equipment through the moonpool to the sea bottom begins by skidding the equipment on the movable moonpool hatches by using the transversal and longitudinal push pull units and then connecting the lifting wire and the guiding wires to the equipment. The next steps include connecting the auxiliary trolley to the equipment and hoisting the equipment by using the main hoist. Next, the method includes moving the longitudinal push-pull unit and the skid carts out of the way and clearing the moonpool by moving the movable hatches to the sides of the moonpool.

The method for lowering equipment through the moonpool to the sea bottom continues by lowering the equipment together with the auxiliary trolley and main trolley into the moonpool and disconnecting the main trolley and the auxiliary trolley when the equipment has reached the bottom of the moonpool. The method ends by lowering the equipment to the sea bottom, hoisting the auxiliary trolley out of the moonpool, and closing of the movable hatches.

A method for handling suction piles begins by skidding of the suction pile in horizontal position to the centerline of the moonpool, connecting the suction pile to the main hoist and any umbilical cables, and hoisting the suction pile to a vertical position by the main hoist. The method continues by connecting the auxiliary trolley to the suction pile, moving the longitudinal push-pull unit and the skid carts out of the way, and clearing the moonpool by moving the movable hatches to the sides of the moonpool.

The method for handling suction piles continues by lowering of the suction pile into the moonpool, disconnecting the auxiliary trolley and the main trolley when suction pile reaches the bottom of the moonpool, and lowering the suction pile to the sea bottom. The method ends by hoisting the auxiliary trolley out of the moonpool and closing the movable hatches.

A method for handling ROV's begins by skidding the ROV with catching basket to the centerline of the moonpool, connecting the ROV to the main hoist and the auxiliary hoist, and hoisting of the ROV. The method continues by moving the longitudinal push-pull unit and the skid carts out of the way, clearing the moonpool by moving the movable hatches to the sides of the moonpool, and lowering the ROV into the moonpool. The method ends by disconnecting the ROV from basket when the ROV reaches the bottom of the moonpool, hoisting the basket, and closing of the movable hatches.

A method for catching and spreading wires running through the moonpool begins by closing the movable hatches, stabilizing the wires with the movable fenders of the movable hatches in a first direction. The method continues by stabilizing the wires in a second direction perpendicular to a first direction by moving secondary hatches. The method ends by locking the wires in wire spreaders and spreading the wires.

A method for handling equipment modules on the vessel begins by locking the module to the transversal push-pull unit and moving the module over the transversal rail to the longitudinal rail by the push-pull unit. The method continues by skidding the longitudinal push pull unit, locking of longitudinal push-pull unit to the module, and unlocking of the transversal push-pull unit of the module. The last step of the method entails moving the module by the longitudinal push-pull unit in longitudinal direction of the vessel.

The embodied systems and methods do not require a flex joint to connect the segments of the tower together. The multipurpose tower can be of one-piece construction to avoid problems that arise with typical multipurpose towers that comprise at least an upper section and a lower section.

While these embodiments have been described with emphasis on the preferred embodiments, it should be understood that within the scope of the appended claims the embodiments might be practiced other than as specifically described herein.

What is claimed is:

1. A monohull vessel with a moonpool capable of being used offshore comprising:

a. the monohull vessel with the moonpool comprising a moonpool topside, wherein the monohull vessel further comprises a deck level;

b. a multipurpose tower mounted on the monohull vessel;

c. an equipment handling system removably mounted on the vessel;

d. a movable hatch connected to moonpool topside, wherein the movable hatch is countersunk beneath the deck level, wherein the movable hatch consists of two separate parts which can move outwardly to both sides of the moonpool; and e. a hoist system located inside the monohull vessel.

2. The monohull vessel of claim 1, wherein the wherein monohull vessel further comprises longitudinal bulkheads and wherein the multipurpose tower is orientated on the monohull vessel perpendicular to the longitudinal bulkheads.

3. The monohull vessel of claim 1, wherein the wherein monohull vessel further comprises transversal bulkheads and wherein the multipurpose tower is orientated on the monohull vessel perpendicular to the transversal bulkheads.

4. The monohull vessel of claim 1, wherein the multipurpose tower is a derrick.

5. The monohull vessel of claim 1, wherein the equipment handling system is removably mounted on the monohull vessel.

6. The monohull vessel of claim 1, wherein the hoist system is mounted inside the monohull vessel.

7. The monohull vessel of claim 1, wherein the hoist system comprises a winch and a compensating system and wherein the compensating system comprises an hydraulic cylinder, pressure vessels, and an active steering hydraulic cylinder.

8. The monohull vessel of claim 7, wherein the winch is a traction winch.

9. A monohull vessel with a moonpool capable of being used offshore comprising:

a. the monohull vessel with the moonpool comprising a moonpool topside, wherein the monohull vessel further comprises a deck level;

b. a multipurpose tower mounted on the monohull vessel, wherein the multipurpose tower comprises i. a mast comprising a mast top side, a mast bottom side, a mast forward side, and a mast back side;

ii. a plurality of cable blocks connected to the mast top side;

iii. a main trolley comprising a first gripper moveably connected to the mast forward side;

iv. an auxiliary trolley comprising a second gripper moveably connected to the mast forward side;

v. at least one main hoist connected to the mast;

vi. a least one secondary hoist connected to the mast and the auxiliary trolley adapted to move the auxiliary trolley relative to the mast; and vii. a hoisting cable connected to the at least one main hoist adapted to be guided over the plurality of cable blocks and adapted to move the main trolley relative to the mast;

c. an equipment handling system removably mounted on the vessel;

d. a movable hatch connected to moonpool topside; and e. a hoist system located inside the monohull vessel.

10. The monohull vessel of claim 9, wherein the multipurpose tower further comprises a third hoist and an elevating work platform movably fixed to the mast, wherein the third hoist is connected to the elevating work platform, and wherein the third hoist is adapted to move the elevating work platform relative to the mast.

11. The monohull vessel of claim 10, wherein the elevating work platform comprises a wind wall.

12. The monohull vessel of claim 9, wherein the multipurpose tower further comprises a plurality of winches and a plurality of cables adapted to position the main hoist trolley and auxiliary trolley relative to the mast.

13. The monohull vessel of claim 12, wherein the multipurpose tower further comprises a shape of a hollow tube to accommodate the plurality of winches and the plurality of cables.

14. The monohull vessel of claim 9, wherein the multipurpose tower further comprises a storage area located outside of the mast adapted to store a plurality of tubulars.

15. The monohull vessel of claim 9, wherein the number of main hoists ranges from one to ten.

16. The monohull vessel of claim 9, wherein the main trolley comprises a vertical rotating drive.

17. The monohull vessel of claim 9, wherein the auxiliary trolley is adapted to pass the main trolley.

18. The monohull vessel of claim 9, wherein the auxiliary trolley further comprises at least one arm adapted to move outward.

19. The monohull vessel of claim 18, wherein the auxiliary trolley further comprises at least one hydraulic cylinder arm adapted to move the arm outward.

20. The monohull vessel of claim 9, wherein the auxiliary trolley is adapted to allow a man to ride the auxiliary trolley.

21. The monohull vessel of claim 9, wherein the wherein monohull vessel further comprises longitudinal bulkheads and wherein the multipurpose tower is orientated on the monohull vessel perpendicular to the longitudinal bulkheads.

22. The monohull vessel of claim 9, wherein the wherein monohull vessel further comprises transversal bulkheads and wherein the multipurpose tower is orientated on the monohull vessel perpendicular to the transversal bulkheads.

23. The monohull vessel of claim 22, wherein the movable hatch moves perpendicular to the longitudinal axis of the transversal bulkheads.

24. The monohull vessel of claim 22, wherein the movable hatch moves parallel to the longitudinal axis of the transversal bulkheads.

25. The monohull vessel of claim 9, wherein the movable hatch consists of two separate parts which can move outwardly to both sides of the moonpool.

26. The monohull vessel of claim 9, wherein the hoist system comprises a winch and a compensating system and wherein the compensating system comprises an hydraulic cylinder, pressure vessels, and an active steering hydraulic cylinder.

27. The monohull vessel of claim 26, wherein the winch is a traction winch.

28. A monohull vessel with a moonpool capable of being used offshore comprising:

a. the monohull vessel with the moonpool comprising a moonpool topside, wherein the monohull vessel further comprises a deck level;

b. a multipurpose tower mounted on the monohull vessel;

c. an equipment handling system removably mounted on the vessel;

d. a movable hatch connected to moonpool topside, wherein the movable hatch is countersunk beneath the deck level; and e. a hoist system located inside the monohull vessel, wherein the hoist system comprises a winch and a compensating system and wherein the compensating system comprises an hydraulic cylinder, pressure vessels, and an active steering hydraulic cylinder.

29. The monohull vessel of claim 28, wherein the wherein monohull vessel further comprises longitudinal bulkheads and wherein the multipurpose tower is orientated on the monohull vessel perpendicular to the longitudinal bulkheads.

30. The monohull vessel of claim 28, wherein the wherein monohull vessel further comprises transversal bulkheads and wherein the multipurpose tower is orientated on the monohull vessel perpendicular to the transversal bulkheads.

31. The monohull vessel of claim 30, wherein the movable hatch moves perpendicular to the longitudinal axis of the transversal bulkheads.

32. The monohull vessel of claim 30, wherein the movable hatch moves parallel to the longitudinal axis of the transversal bulkheads.

33. The monohull vessel of claim 28, wherein the movable hatch consists of two separate parts which can move outwardly to both sides of the moonpool.

34. The monohull vessel of claim 28, wherein the multipurpose tower is a derrick.

35. The monohull vessel of claim 28, wherein the equipment handling system is removably mounted on the monohull vessel.

36. The monohull vessel of claim 28, wherein the hoist system is mounted inside the monohull vessel.

37. The monohull vessel of claim 28, wherein the winch is a traction winch.

* * * * *